US005634779A

United States Patent [19]

Eysymontt

[11] Patent Number: 5,634,779

[45] Date of Patent: Jun. 3, 1997

[54] HYDRAULIC FLUID-DRIVEN, MULTICYLINDER, MODULAR RECIPROCATING PISTON PUMP

[75] Inventor: Jan L. Eysymontt, Nyon, Switzerland

[73] Assignee: FDP Engineering SA, Nyon, Switzerland

[21] Appl. No.: 535,062

[22] PCT Filed: May 5, 1994

[86] PCT No.: PCT/IB94/00095

§ 371 Date: Jan. 5, 1996

§ 102(e) Date: Jan. 5, 1996

[87] PCT Pub. No.: WO94/25755

PCT Pub. Date: Nov. 10, 1994

[30] Foreign Application Priority Data

May 5, 1993 [EP] European Pat. Off. ..... 93810328

[51] Int. Cl.[6] ..... F04B 9/10; F04B 49/06

[52] U.S. Cl. ..... 417/342; 417/344; 417/346

[58] Field of Search ..... 417/342, 344, 417/346

[56] References Cited

U.S. PATENT DOCUMENTS

| | | | |
|---|---|---|---|
| 3,662,652 | 5/1972 | Cole | 91/411 R |
| 3,847,511 | 11/1974 | Cole | 417/342 |
| 3,981,622 | 9/1976 | Hall et al. | 417/344 X |
| 3,994,627 | 11/1976 | Calzolari | 417/344 X |
| 4,470,771 | 9/1984 | Hall et al. | 417/342 |
| 4,490,096 | 12/1984 | Box | 417/344 X |
| 4,555,220 | 11/1985 | Hall et al. | 417/342 |

FOREIGN PATENT DOCUMENTS 3428629 5/1985 Germany .

*Primary Examiner*—Richard E. Gluck
*Attorney, Agent, or Firm*—Alfred D. Lobo

[57] ABSTRACT

A hydraulic fluid-driven, multicylinder, modular, reciprocating piston pumping machine of non pulsating flow and independently variable forward and return stroke speeds comprises several pumping modules (A, B . . . E) each having one primary cylinder (A1, B1 . . . E1) and one secondary cylinder (A2, B2 . . . E2) coaxially joined by an angularly and radially oscillating bushing (100) through which slides a piston rod (A3, B3 . . . E3) with an angularly oscillating piston (A4, B4 . . . E4; A5, B5 . . . E5) at each of its ends. Each primary cylinder (A1, B1 . . . E1) has the end opposed to the bushing closed by valve monifolds (A11, B11 . . . E11) interconnected through a pressurized hydraulic fluid distritubor conduit (5) through which pressurized hydraulic fluid is supplied to the primary cylinder of each module by at least one hydraulic pump (1, 2). A hydraulic fluid chamber (A18, B18 . . . E18) formed in each primary cylinder by the piston back, said bushing (100), the rod's surface and the cylinder's interior wall, communicates with all such chambers (A18, B18 . . . E18) of the rest of the modules by a distributor-collector conduit (11 ) provided with at least one hydro-pneumatic accumulator (12) connected to a relatively large, second supplementary gas reservoir (23) constituting a volumetric compensator for all the hydraulic fluid contained in all said chambers (A18, B18 . . . E18), and at the same time providing pressure for the pistons back stroke. One or more further hydro-pneumatic accumulators (8) are provided in a return fluid collector connected (7) to the valve manifolds (A11, B11 . . . E11), and further individual hydro-pneumatic accumulators (A14, B14 . . . E14) are provided for the valve manifolds (A11, B11 . . . E11).

11 Claims, 7 Drawing Sheets

HYDRAULIC FLUID-DRIVEN, MULTICYLINDER, MODULAR RECIPROCATING PISTON PUMP

FIELD OF THE INVENTION

The instant invention relates to reciprocating linear motion piston pumps, driven by hydraulic fluid, referred to hereinafter as pumps or pumping machines.

PRIOR ART

Predominantly, two-piston pumping machines are in use, although one-piston and three-piston pumps also exist. Such pumps are employed for the pumping of concrete and other difficult to move materials. These are the only pumps capable of moving such materials at high pressures.

The present technology uses long piston strokes, mostly in the neighborhood of 2 meters, in order to lengthen cylinder life, especially when abrasive materials are pumped.

In two-piston machines, the advance of one of the two pistons causes the other piston to return, by means of displacing into the other cylinder, behind its piston, the hydraulic fluid contained in the chamber formed by the cylinder wall, the piston rod, the piston's back and the rod gland (bushing, sealing the rod's exit from the hydraulic cylinder to the "material" or "pumping" cylinder). This mechanism operates with equal advance and return piston speeds. The simultaneous arrival of the advancing and returning pistons to their respective end and beginning points of the stroke implies a short interruption in the pump's flow at the end of each stroke.

This is corrected, in one existing design, at the expense of an additional hydraulic circuit which slowly closes the advancing piston's hydraulic fluid admission valve as the other piston's admission valve is being opened.

The problem of pulsations, i.e. the additional variation in the pump's delivery flow due to the unavoidable compression of the long column of material in the material cylinder being pumped at the beginning of each stroke, is solved, in one existing design, by adding a third cylinder. As one of the three pistons advances, the second piston returns and the third piston precompresses its column.

U.S. Pat. No. 3,662,652 discloses a hydraulic pump as set out in the pre-characterizing part of claim 1, having at least three power cylinders in fluid communication with one another and which are operable in a cycle with suction, precompression and discharge phases.

The main shortcomings of the available technology are:

a) The presently available designs imply the need for as many sizes of the machine as there might be different flow requirements. This means that many different size components have to be manufactured and stocked.

b) The known machines are integral units and any maintenance requires stopping the pumping operation until the machine is repaired.

c) The means employed to eliminate variations in the machine's flow (pulsation) require an additional hydraulic circuit and a third cylinder, involving complex design and considerable additional cost.

d) The long strokes adopted lead to radial stresses on the piston, the rod, the bushing and the cylinder walls. These stresses, to date, have been unavoidable and are due to even the slightest deviation of the hydraulic and pumping cylinders' axis. The phenomenon, sometimes referred to as piston blocking, causes premature cylinder, rod, piston guides and bushing wear, and is responsible for an important loss in mechanical efficiency.

e) The hydraulic fluid valves employed (mainly when fixed displacement hydraulic pumps are used to drive the machine) are either conventional, directional spool valves or the so-called two-way directional logic element, cartridge valves. In the first case, considerable pressure drops are present, which are inherent in the spool valve design. In the second case, pressure drops are present due to the spring closing the valve.

f) When the machines are used to pump materials that can be handled by disk valves, disk valves of conventional design are used. Since these valves were originally designed to be used in mechanical piston or plunger pumps at much higher closing speeds, they cause an unduly high pressure drop in the hydraulically driven piston pumps, where more closing time is available. In such pumps, specially designed disk valves should be employed.

g) The maximum speed of the return stroke is, in every case, imposed by the material being pumped i.e. the suction conditions. Since the advance and return stroke speeds are necessarily equal in the known pumps, the advance stroke's maximum speed is unnecessarily limited, reducing the pump's potential capacity. Inversely, when low viscosity material is being pumped, or when sufficiently high feeding pressures are present, it would be of advantage to use high return stroke (suction stroke) speed, while the advance speed may be limited by other factors, such as, for example, wear considerations. During the forward stroke, especially at high pressure, the wear rate in the cylinder walls and the piston seals is much higher than during the return stroke.

OBJECTS OF THE INVENTION

Taking into account the above mentioned limitations inherent in the state of the art technology, it is one object of this invention to provide a pump capable of delivering a non-pulsating high pressure flow.

It is also an object of this invention to provide a high global efficiency pump by introducing floating pistons and bushing, drastically reducing the friction, and valves having lower pressure drops.

It is also an object of this invention to provide a modular pump that requires a minimum of different size components to be manufactured and stocked, and which permits maintenance operations almost without stopping the machine. This modular concept allows great flexibility in the use of the available modules, permitting same to be added or withdrawn from operation, or transferred from one installation to another.

It is a further object of this invention to provide a pump with a hermetically closed hydraulic circuit, which is not exposed to air oxidation and water vapor condensation.

It is another object of this invention to provide a pump in which the components in mutual movement produce a minimum of wear. This is attained by floating pistons and bushing.

It is still another object of this invention, and a very important one, to provide a pump in which the forward and the return speeds of the stroke are variable and independent one from the other.

SUMMARY OF THE INVENTION

These objects, and others which will become apparent from the following explanation of one of the preferred embodiments of this invention, are attained by a hydraulic fluid-driven, multicylinder, modular, reciprocating piston pumping machine, of non pulsating flow and independently variable forward and return stroke speeds, composed of several like pumping modules, each comprising one primary and one secondary cylinder, coaxially joined to each other by interposition of a bushing through which slides a piston rod with a piston attached to each of its ends. Each primary cylinder has the end opposed to the bushing closed by a valve manifold, and all the individual modular valve manifolds are interconnected through a pressurized hydraulic fluid distributor conduit through which pressurized hydraulic fluid is supplied by at least one hydraulic pump, the pressurized hydraulic fluid being supplied to the primary cylinder of each module.

A hydraulic fluid chamber formed in each primary cylinder by the piston's back, the abovementioned bushing, the rod's surface and the cylinder's interior wall, communicates by means of a distributor-collector conduit with all such chambers of the rest of the modules, said distributor-collector conduit being provided with at least one hydro-pneumatic accumulator connected to a relatively large, supplementary gas reservoir. This accumulator constitutes a volumetric compensator for all the hydraulic fluid contained in all the aforementioned chambers, and at the same time provides the pressure for the back stroke of the pistons.

Advantageously, and particularly if the pumping machine is being used at high pressures, each modular valve manifold is connected to the pressurized hydraulic fluid distributor conduit via a shut-off valve, all said manifolds being connected in parallel by means of a return hydraulic fluid collector conduit and also being connected to at least one second hydro-pneumatic accumulator, this second accumulator being connected to a relatively large, second supplementary gas reservoir.

Again, if the pumping machine is being used at high pressures, each modular valve manifold preferably has an individual third hydro-pneumatic accumulator supplied with pressurized hydraulic fluid from the manifold, each of these third accumulators being connected to a large pressurized third supplementary gas reservoir, providing all these third accumulators with additional pressurized gas volume, the volume of this third reservoir being many times larger that the individual gas volume of said third accumulators.

In this embodiment, each modular valve manifold advantageously has three valves: a hydraulic fluid admission valve, a hydraulic fluid return valve and a third valve that communicates with the individual third hydro-pneumatic accumulator provided on each modular valve manifold, each individual third hydro-pneumatic accumulator being supplied with pressurized hydraulic fluid from the manifold through a variable flow restriction passage and a check valve.

The aforementioned bushing of each module advantageously constitutes, with respect to the corresponding piston rod, a sealing guide, free to oscillate both angularly and radially in relation to the axis of the cylinders, while the pistons are free to oscillate angularly with respect to the piston rod's axis.

The distributor-collector is preferably connected at one of its ends to a filtered and cooled hydraulic fluid supply from an auxiliary pump equipped with a filter, its opposite end being connected to a flow restriction valve and a filter from which the fluid goes to the return hydraulic fluid collector conduit Each secondary cylinder is provided, at the end opposed to the bushing, with suction and delivery valves that connect the individual module to the suction distributor conduit and to the delivery collector conduit, respectively. Both of these latter conduits are equipped with shut-off valves at their connection to the individual module.

The initial position of the pump's pistons, before the pump is started, is a function of (i) the number of modules composing the pump and (ii) the relation between the forward and return speeds of the pistons. At any moment during the pump's work cycle, as long as the hydraulic fluid flow from the hydraulic pump is kept constant, the sum of the individual speeds of the advancing pistons is equal to the sum of the individual speeds of the returning pistons, being the product of this sum by the hydraulic cylinder's section equivalent to the delivery of the hydraulic pump.

Each module may comprise at least one piston position detector whose position is adjustable in accordance with the pump's operating conditions, but located in the vicinity of the end of the forward stroke, its exact position being determined, in each case, depending on the advance speed of the piston, the number of valves to open and close in sequence before the actual end of stroke takes place, and the time required by the corresponding valves' operating sequence.

Additional piston position detectors can be provided on some of the modules when the forward piston's speed varies during the pump's complete work cycle. Such detectors are also adjustable along the length of the stroke but located in an intermediate position between the beginning and the end of the stroke, their exact position being determined, in each case, in accordance with the pump's operating conditions.

The detectors' signal to the pump's electronic logic control unit imparts orders to open or to close to the corresponding valves, in proper timing and sequence, programmed in this electronic logic control unit for all operating conditions of the pump. Each valve is equipped with a position sensor signalling to the control unit the valve's condition: open or closed. Instead of using position detectors, it is also possible to control the valves based on the stroke timing as a function of the hydraulic pumps flow using a microprocessor control.

The hydraulic fluid collector conduit preferably discharges into a least one hydraulic fluid heat exchanger delivering hydraulic fluid back to the hydraulic pump.

Also, the distributor-collector conduit may be connected at one of its ends to a filtered and cooled hydraulic fluid supply coming from an auxiliary pump equipped with a filter, its opposite end being connected to a flow restriction valve and a filter from which the fluid is delivered to the return hydraulic fluid collector conduit.

All the hydraulic fluid conduits, the collector and distributor conduits, the accumulators, hydraulic cylinders, valve manifolds, auxiliary valves, filter(s), heat exchanger(s) and hydraulic pump(s) advantageously constitute a hermetically closed hydraulic circuit that has no contact with the atmosphere.

BRIEF DESCRIPTION OF THE DRAWINGS

Embodiments of the invention are shown by way of example in the accompanying drawings, in which.

DESCRIPTION OF PREFERRED EMBODIMENTS

In the Figures, similar components are indicated with the same references.

Figure 1:
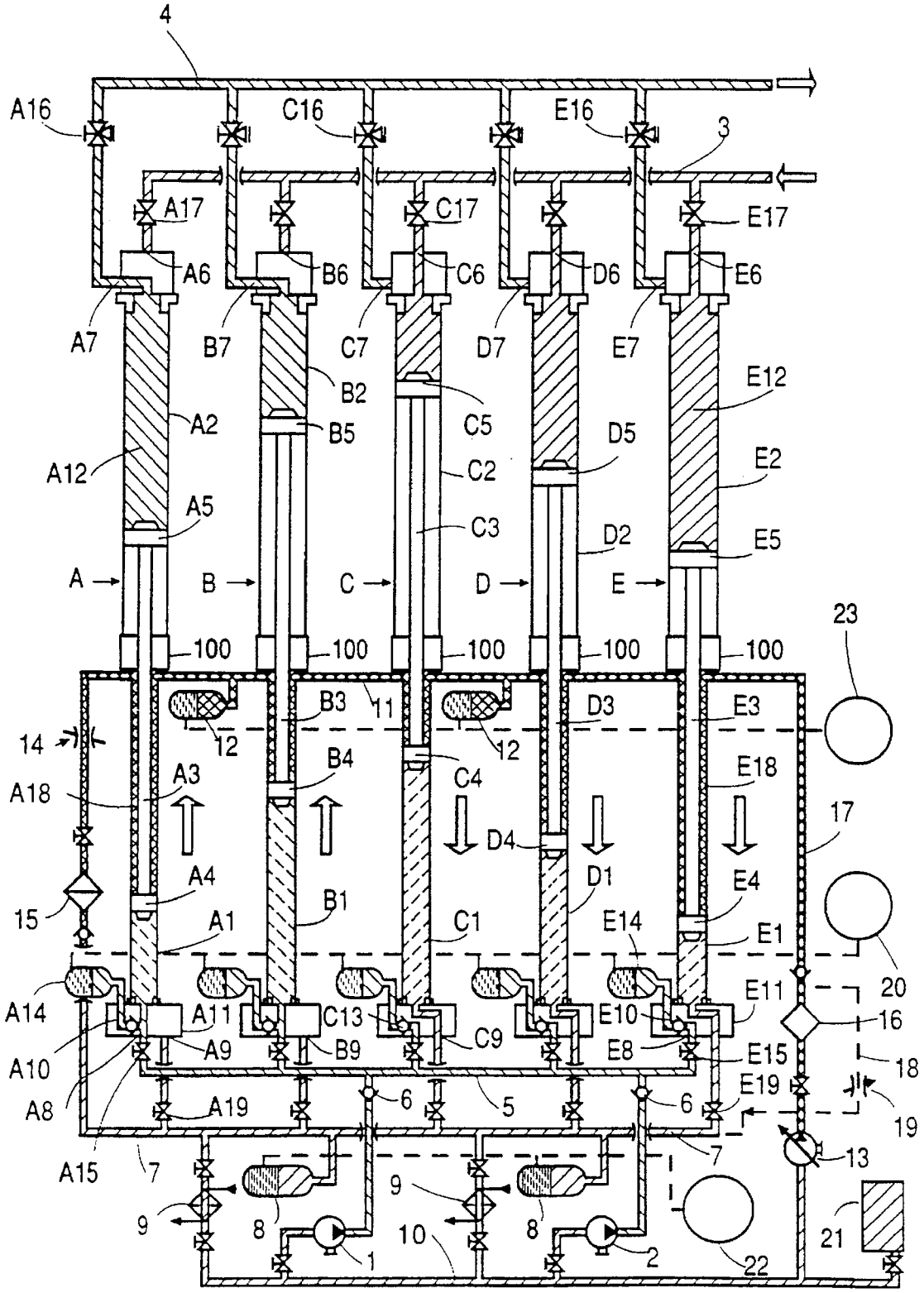
FIG. 1 is a simplified layout of one embodiment of the invention.

The pumping machine of the invention is based on the concept that it is built from modular, multiple pumping units. The embodiment of FIG. 1, is built of five equal modular units A, B, C, D, E, each being an assembly of a primary or hydraulic fluid cylinder A1, B1 . . . E1, assembled to a secondary or material cylinder A2, B2 . . . E2, along their common longitudinal axis and housing a common piston rod A3, B3 . . . E3, with two pistons, respectively A4, B4 . . . E4, and A5, B5 . . . E5, fixed to the rod's ends. These pumping modules A, B . . . E may be composed of equal or different diameter primary and secondary cylinders, depending on the pressure employed in the hydraulic cylinder and the required delivery pressure of the pump. Each module further incorporates a suction valve situated at the intake A6, B6 . . . E6 of the material to be pumped, a delivery valve situated at the material outlet A7, B7 . . . E7, a valve manifold A11, B11 . . . E11, closing each primary cylinder's end and containing a hydraulic fluid admission valve A8, B8 . . . E8, a hydraulic fluid return valve A9, B9 . . . E9, and a third directional valve A10, B10 . . . E10.

The purpose of this third directional valve A10, B10 . . . E10 is to admit additional hydraulic fluid into the cylinder A1, B1 . . . E1 at the beginning of the forward stroke in order to precompress the column of material A12, B12 . . . E12 being pumped from the secondary cylinder A2, B2 . . . E2. This additional hydraulic fluid is derived from the pressurized hydraulic fluid supply provided by two main hydraulic pumps 1, 2 through an adjustable restricted flow passage in the manifold A11, B11 . . . E11, equipped with a check-valve A13, B13 . . . E13 and leading to a hydropneumatic accumulator A14, B14 . . . E14.

Each accumulator A14, B14 . . . E14 receives hydraulic fluid continuously through the adjustable flow restriction at a rate that will charge it with a pre-calculated amount of fluid during the combined length of the forward and return strokes. The accumulator will then unload this amount of hydraulic fluid into the cylinder through said third directional valve A10, B10 . . . E10 at the beginning of the forward stroke just before the main hydraulic fluid admission (pressure) valve A8, B8 . . . E8 is opened. In order to reduce to a minimum the pressure drop during the accumulator's discharge, all these accumulators A14, B14 . . . E14 are connected to one additional gas reservoir 20. The capacity of reservoir 20 is many times the capacity of each individual accumulator A14, B14 . . . E14, and the quantity of hydraulic fluid necessary to produce the precompression of the column of the material being pumped (equal to the length of the secondary cylinder) is less than 0.5 liter (which is the case when pumping at pressures of under 350 bar, with a cylinder length of +/−2.5 m, and a hydraulic fluid cylinder of 100 mm diameter), whereby the pressure drop in each accumulator A14, B14 . . . E14 can be kept at less than 1% with a gas volume of only 50 liter. In such case, there will be no noticeable delivery oscillation in the pump's flow when the module's main hydraulic fluid admission valve A8, B8 . . . E8 is opened.

The intake of pressurized hydraulic fluid from the main pumps 1, 2 to the manifold A11, B11 . . . E11 is provided with a shut-off valve A15, B15 . . . E15 which allows the individual module A, B . . . E to be disconnected from the machine. A three-way shut-off valve A16, B16 . . . E16 is provided at each module's delivery end and connects it to delivery collector conduit 4. This valve serves an identical purpose as the preceding one and also, being a three-way valve, permits by-passing of the module's delivery flow. This arrangement allows the pump to be run under no load when convenient.

The individual modules are connected to the pump's suction distributor conduit 3 via a shut-off valve A17, B17 . . . E17 also enabling the module to be disconnected from the pump.

All the modules are interconnected by a pressurized hydraulic fluid distributor conduit 5 to which one hydraulic fluid pump, or preferably two pumps 1, 2 are connected. Whenever possible, it is convenient to install multiple hydraulic pumps in parallel, to allow for any one of them to be disconnected for maintenance, without stopping the machine. The total delivery of the machine is thus only partially reduced while the hydraulic pump is being serviced.

Both hydraulic pumps 1, 2 are connected to the pressurized hydraulic fluid distributor conduit 5 through a check valve 6.

All the modules deliver the hydraulic fluid returning during the return stroke to a common hydraulic fluid collector conduit 7 onto which at least one hydro-pneumatic accumulator 8 is mounted. It is preferable to provide at least two accumulators 8 instead of one, as this allows any one of them to be disconnected at any time, for maintenance.

These hydraulic accumulators 8 fulfill the following functions: they absorb all the hydraulic fluid volume variations occurring in the return portion of the hydraulic circuit of the machine and, at the same time, they pressurize this part of the circuit, allowing the hydraulic pump(s) to be fed at any desired pressure. From the return hydraulic fluid collector conduit 7, the hydraulic fluid is pushed, through one or more heat exchangers 9 into a conduit 10 leading the fluid back to the hydraulic pump 1, 2. Several heat exchangers 9 in parallel are preferred for the same reasons as have been explained concerning the return circuit accumulators. The conduit 10 leads to a replenishment hydraulic reservoir 21 which can supply additional hydraulic fluid (oil) to compensate for losses, as needed.

No hydraulic fluid reservoirs in the circuit are open to air. It is a sui-generi closed hydraulic circuit, in which all the hydraulic fluid is completely isolated from the atmosphere. There is no water vapour penetration into the fluid and no fluid oxidation. As long as the fluid is adequately filtered, practically no oil changes are necessary and, at the same time, a minimum quantity of oil is in circulation. An additional advantage is that the hydraulic pumps' suction inlets are fed with fluid at any desired pressure, which allows for higher rotation speeds. In order to reduce the pressure oscillation of the returning hydraulic fluid in the heat exchanger(s) and at the suction inlets of the hydraulic pump(s), the accumulators 8 are connected to an additional gas reservoir 22 (one for the whole machine) whose gas volume is much larger than the total combined gas volume of the accumulators 8. A 1:10 ratio of the combined gas volume of accumulators 8 to the volume of reservoir 22 reduces the possible pressure oscillation proportionally. This means that if one chooses to have a pressure of 1.3 bar absolute at the inlet of pumps 1, 2, this oscillation would be kept under 0.13 bar. The pressure in the return portion of the hydraulic circuit of the machine can be changed instantly and simply by admitting the necessary additional compressed gas, usually nitrogen, into reservoir 22, or venting the excess if the pressure has to be lowered.

The hydraulic fluid valve's manifold of each module also constitutes the hydraulic cylinder's head. The three valves contained in the manifold A11, B11 . . . E11 are of cartridge type, of novel design and are governed by conventional solenoid pilot valves, mounted upon the cartridges' covers.

The pilot valves (three per module) of each module, are connected to the machine's central control board (panel) in which a PLC (Programmed Logic Control), or a similar microprocessor circuit, is provided to coordinate their action. The hydraulic fluid directional valves proper (or the main valves) which are of insertable cartridge type (see FIG. 6) and are installed in each individual modules' valve manifold A11, are of novel design, but pertain to the category of so-called two way "logic elements", and are indicated by reference numbers 300.

This main valve 300, which is a secondary object of the invention, exhibits very low pressure drops, particularly due to the fact that no spring is used to close the valve. The valve has a generally cylindrical poppet body 303 slidably mounted in a sleeve 304 with interposed seals 305. The poppet body 303 has an inclined annular seat area 302 adjacent its end that can bear against an annular seat 306, its other end defining a pilot area 301. The seat area is inclined at an angle of less than 45° with respect to the poppet body axis, in order to provide a self-centering effect on the annular seat 306, formed of a hard steel ring mounted with play in an annular recess and held by a retaining ring whereby the seat 306 floats with radial freedom.

Figure 6:
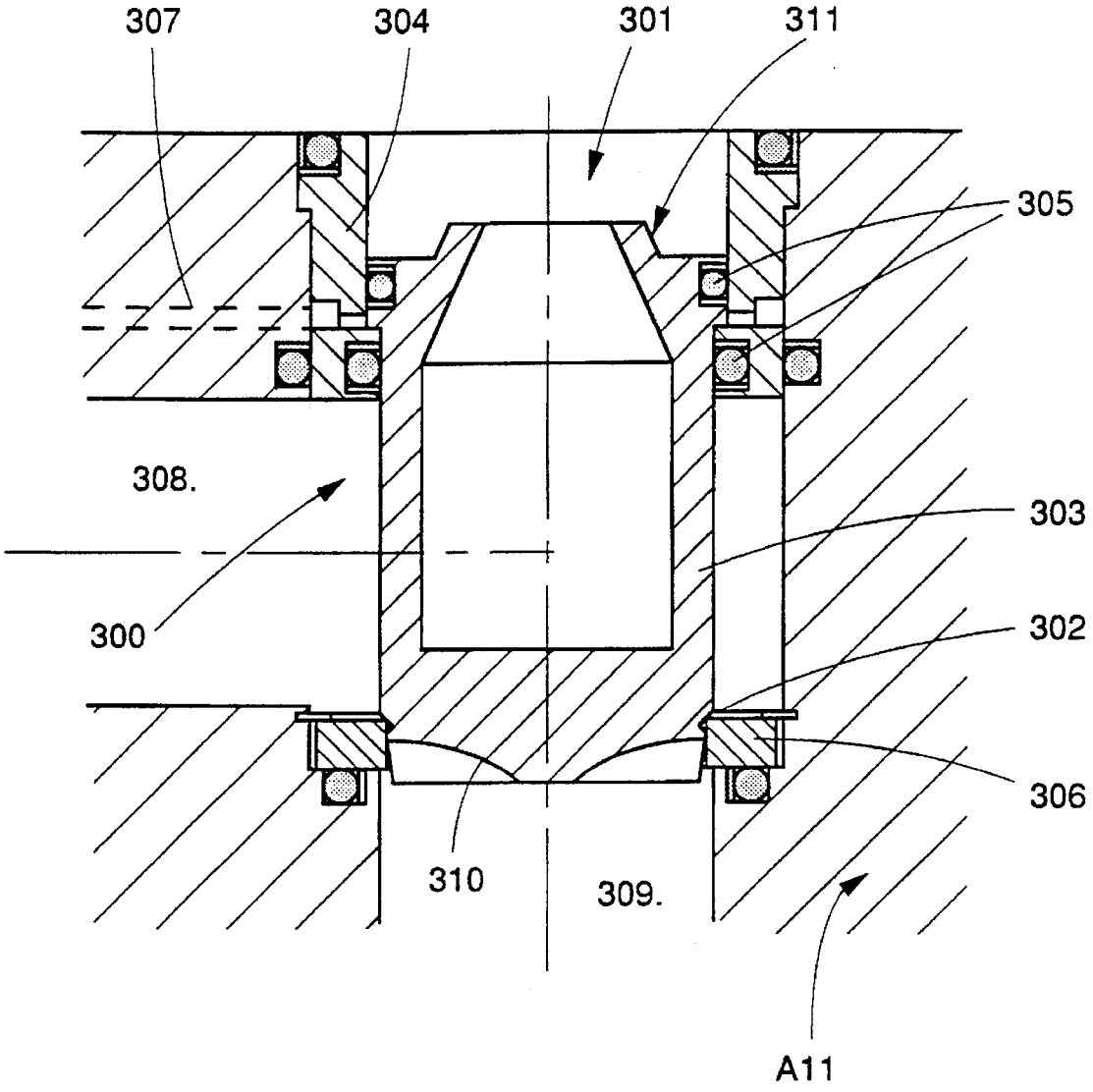
FIG. 6 is a cross section of a preferred embodiment of the hydraulic fluid main directional two-way valve, three of which are contained in each modular valve manifold.

FIG. 6 shows the valve in its closed position wherein the main fluid conduits 308 and 309 are out of communication. The valve closes automatically in response to fluid pressure acting on its pilot area 301 because this pilot area is larger than the area enclosed by the inner diameter of the annular seat 306. A pilot fluid conduit 307 is provided for opening the valve. The lower end of poppet body 303 optionally has a profiled end 310 designed to brake its movement and thus provide a fine control land when it moves to the closed position. The pilot area also optionally has a profiled surface 311, which can fit in a corresponding cavity shape in the cover designed to provide a fine control land when the valve opens.

Additional advantages of this design are: the valves are smaller; there is no leakage because the poppet body 303 and the sleeve 304 are provided with seals 305; the poppet body 303 adjusts to the seat 306 without the need for individual adjustment during manufacture; the seat 306 and poppet body 303 can be replaced individually; and both opening and closing of the valve is performed by pilot fluid (four-way piloting) independent of the main system pressure.

The machine's return stroke mechanism will now be explained. This mechanism allows different and variable forward and return speeds of the pistons A4, B4 . . . E4. The advance of the piston, during the forward stroke, displaces the hydraulic fluid contained in the chamber A18, B18 . . . E18 formed by the cylinder wall, the rod's surface, the back of the advancing piston and the rod's bushing 100. The bushing 100 seals the hydraulic cylinder at the end where the rod A3, B3 . . . E3 enters the secondary cylinder A2, B2 . . . E2. This fluid is displaced, via the corresponding connection into the distributor-collector conduit 11 joining all the modules A, B . . . E. Onto this distributor-collector 11 at least one accumulator 12 is mounted. Normally, not less than two accumulators 12 would be available for reasons analogous to those explained in connection with the accumulators 8. Both accumulators 12 are connected to an additional gas reservoir 23, whose volume is many times larger than the gas volume of accumulator(s) 12. The accumulator 12 is kept at a pressure that is estimated to be sufficient to push the machine's piston on the return stroke at the desired speed. That is, the pressure must be correspondingly higher than the combined resistances of the piston's return stroke. These resistances are:

- the friction produced by the movement of both the hydraulic pistons A4, B4 . . . E4 and the secondary pistons A5, B5 . . . E5;
- the pressure drop of the returning fluid on its way back to the hydraulic pump(s) 1, 2;
- the hydraulic pump intake (feeding) pressure;
- the starting inertia of the combined mass of the rod and piston.

The fluid, pressurized by the accumulator(s) 12, pushes back the piston A4, B4 . . . E4 when its return valve A9, B9 . . . E9 opens, permitting the piston to move back. In order to increase or decrease the return speed, the accumulator(s)' pressure must be increased or decreased. This is done very simply and instantaneously by admitting additional nitrogen to reservoir 23 or venting gas from it.

In operation, in many cases, the volume of fluid contained in this part of the machine's hydraulic circuit (the portion governing the return stroke of the pistons) undergoes changes during the machine's complete work cycle. These changes will be clarified later on. Such changes are absorbed by the accumulator(s) 12. The additional gas reservoir 23, being equivalent to many times the combined gas volume of accumulator(s) 12, reduces to an absolute minimum the pressure oscillation in the System. If the combined value of the resistances of the piston's movement on its return stroke can be kept constant, the return stroke's speed during the whole stroke of all the pistons of the machine can be maintained constant at any desired value. In a conventional machine this would not be possible: as already explained, the friction of the pistons cannot be kept constant as the cylinder axis is never perfectly straight and the pistons and the rod are submitted to radial stresses along their stroke, varying from cylinder to cylinder.

Figure 3:
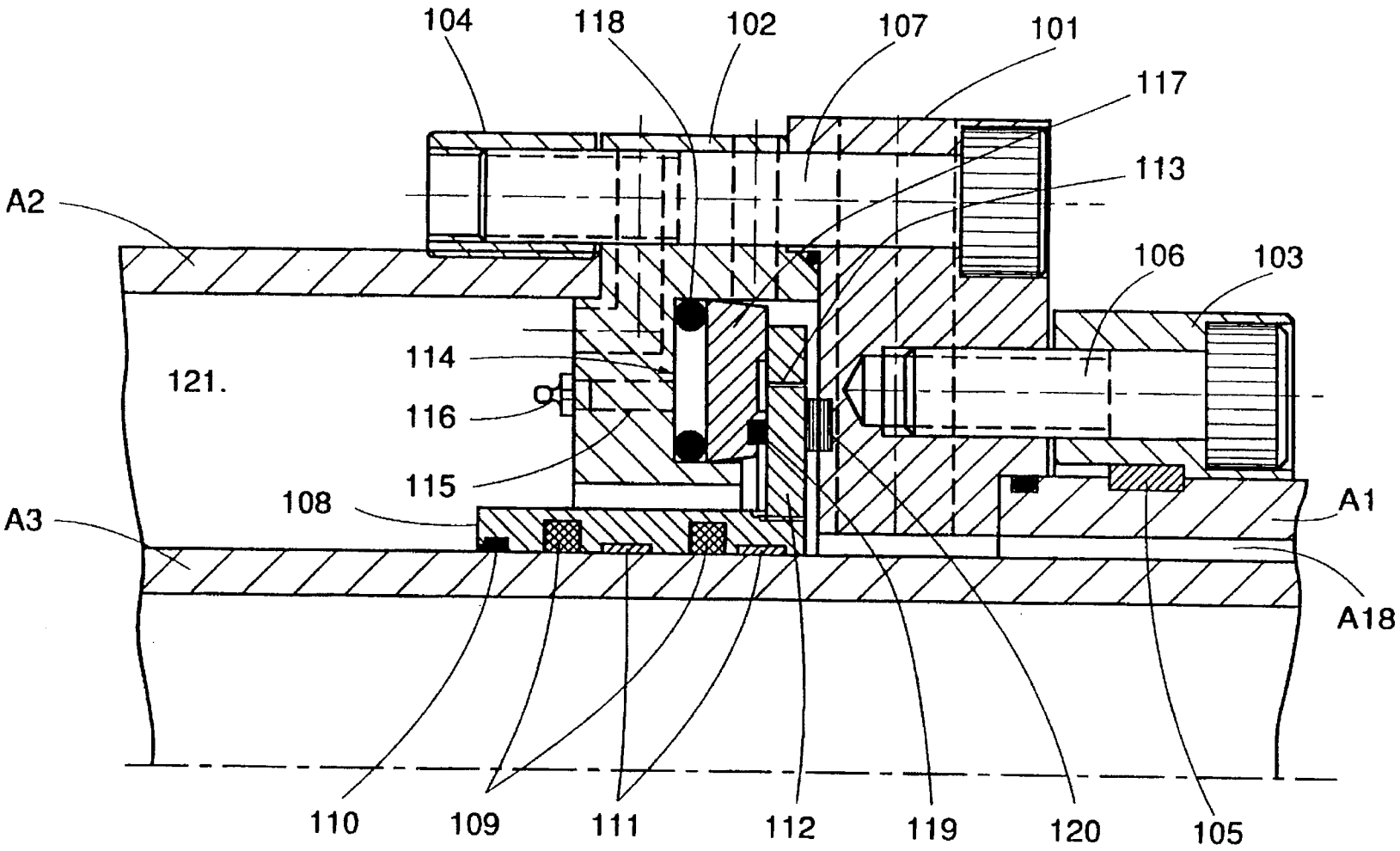
FIG. 3 is a partial longitudinal cross section of a free-to-oscillate bushing.
Figure 4:
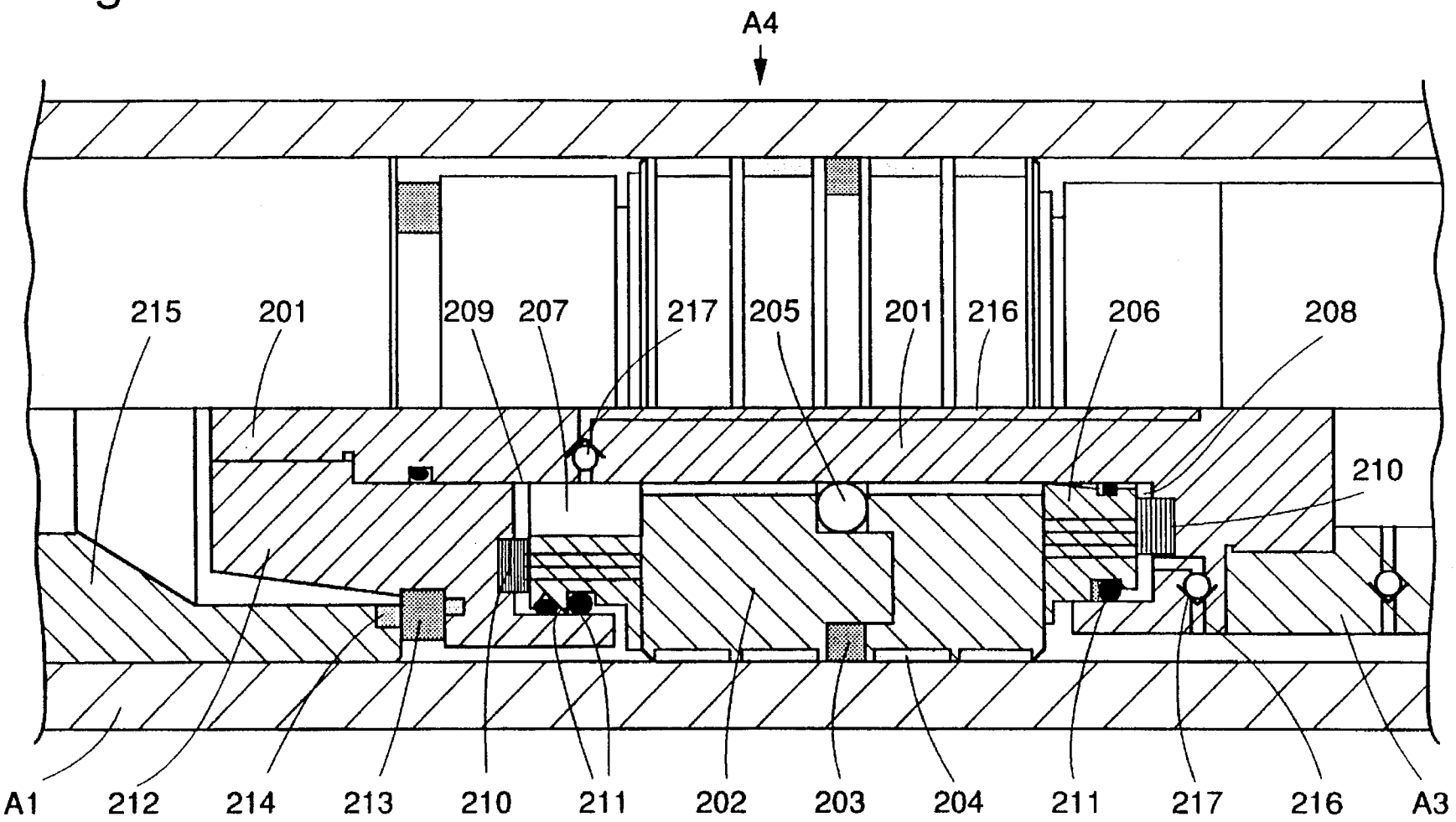
FIG. 4 is a longitudinal partial cross section of one embodiment of a free-to-oscillate piston.
Figure 5:
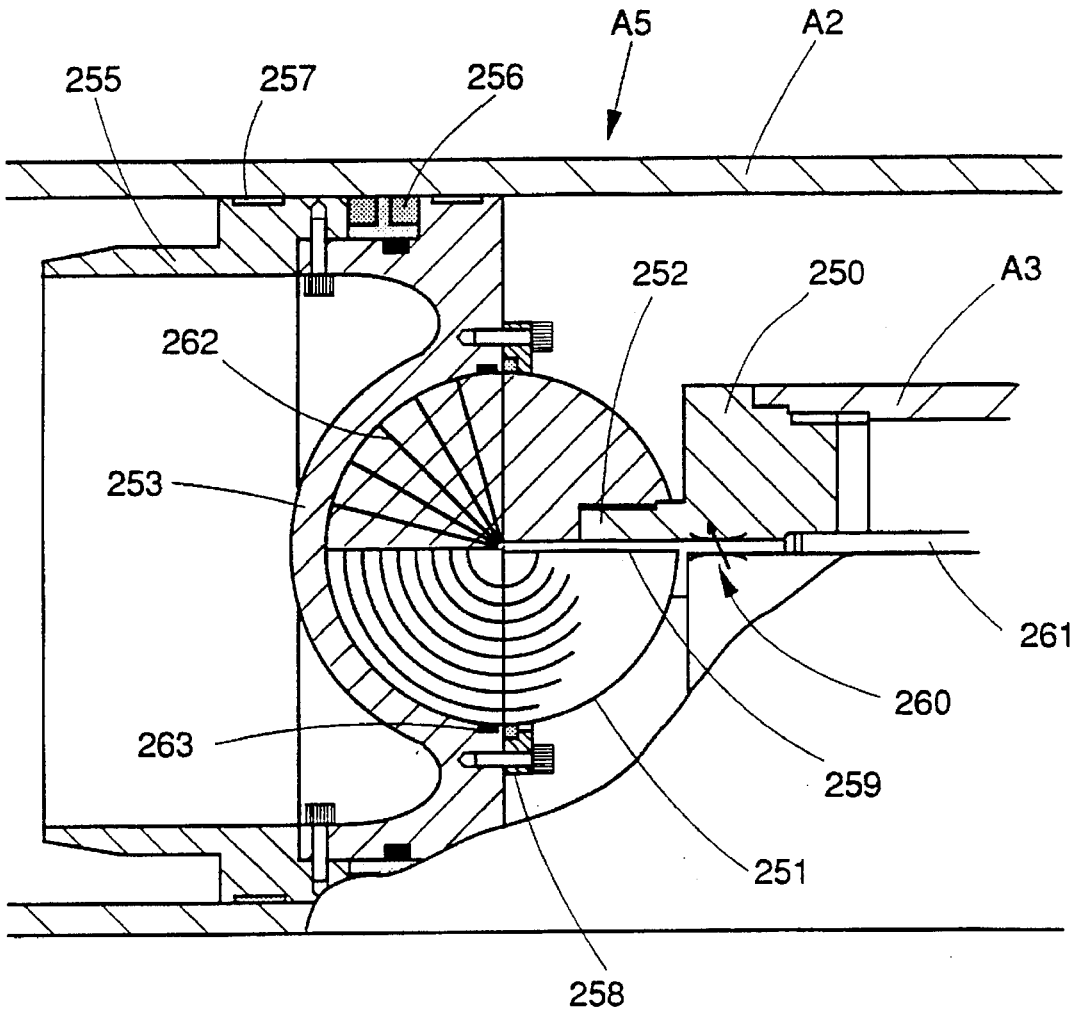
FIG. 5 illustrates another embodiment of oscillating piston.

In order to solve this problem, recourse has been made to a concept which is a secondary object of the invention, and is illustrated in FIGS. 3, 4 and 5.

This concept consists in "floating" bushing and pistons. This solution not only radically eliminates the radial stresses on the pistons, the cylinders, the rods and bushing, it greatly improves the machine's mechanical efficiency by reducing the friction, at the same time reducing the wear. FIG. 3 shows an embodiment of bushing 100, free to oscillate angularly and radially in relation to the axis of the module's cylinders.

In FIG. 3, taking as basis the module A, the floating bushing comprises two annular bodies 101, 102 assembled together between flanges 103, 104. The flange 103 is fixed by a retainer ring 105 on the end of primary cylinder A1 and is fixed to body 101 by a screw 106. Body 101 is secured to body 102 by a screw 107 engaging a threaded bore in flange 104. This flange is screwed on an external screwthread on the end of secondary cylinder A2.

The bushing 100 slides on piston rod A3 by an inner ring 108 forming the bushing proper, this ring having two internal seals 109, a scraper seal 110 and two guides 111 for example made of a reinforced polymer, graphite bronze, etc.. At the primary cylinder end of ring 108 is secured a washer 112 having therein a narrow through bore 113. In the body 102 is an annular groove 114 of rectangular section leading, via a passage 115 closed by a grease nipple 116, into an air chamber 121 formed between secondary cylinder A2, piston rod A3 and bushing 100. These air chambers 121 are open to the atmosphere or may be connected to a supply of coolant or cleaning liquid, as required. The chambers 121 can also be interconnected and connected to a reservoir provided with a membrane to absorb the changes of their total air volume during the machine's work cycle.

In the groove 114 is a ring 117 with slightly conical inner and outer faces, whose largest edges fit closely against the inner and outer faces of groove 114. Between the ring 117 and the bottom of groove 114 are two seals, the space therebetween being filled with an easily deformable solid such as high viscosity paste or grease injected via nipple 116. On its opposite face, ring 117 has an O-ring seal 119 bearing against the opposite contacting face of washer 112. The assembly is completed by a flat spring ring 120 between body 101 and washer 112, which holds the parts together during assembly and when there is no hydraulic pressure behind washer 117.

Between the cylinder A1 and piston rod A3 is the chamber A18 filled with hydraulic fluid such as oil. This oil passes in the space between body 101 and washer 112 and penetrates the narrow bore 113 to lubricate the contacting surfaces of washer 113 and ring 117 which is free to move radially. In operation, the pressure of the hydraulic fluid holds the ring 117 and washer 112 in sliding contact. All bearing surfaces of ring 117, washer 112 and the groove in body 102 are precision ground surfaces.

The bushing 100 has a liberty of angular movement due to the slightly conical shape of ring 117, the conicity of this ring being at least equal to the required angular liberty. Floating of the bushing 100 is achieved by the angular freedom of ring 117 to pivot through slight angles, and radial liberty is provided by the the sliding engagement of ring 117 against washer 112. Thus, deviations of the piston rod A3 from the axis can be absorbed by the floating bushing 101, without detriment to the sealing engagement of the ring 100 on piston rod 103, without prejudice to the integrity of the hydraulic circuit, and without risk of wear to the component parts.

FIG. 4 shows one embodiment of a "floating" piston that is free to oscillate angularly in relation to the piston rod's axis. The illustrated piston is, for example, a primary piston A4 having an inner generally cylindrical piston-supporting spindle 201 secured to the lower end of piston rod A3, for instance by screwing. About spindle 201 is mounted annular piston 202 conveniently made in two parts, and whose inner diameter is greater than the outer diameter of spindle 201. The outer cylindrical surface of piston 202 is provided with at least one outer seal 203 and at least one piston guide ring 204 for example made of reinforced polymer, graphite bronze etc. and which glide against the inner surface of cylinder A1. At the junction of the two parts of piston 202, in its inner surface, is an annular groove receiving a ring of balls 205 forming a pivoting surface for piston 202 on the spindle 201. The two flat end surfaces of piston 202 are held between perforated rings 206, 207 which perform the same function as ring 117 of FIG. 3. Ring 206 has slightly conical inner and outer faces and sits in a right-angled annular groove 208 in spindle 201. Ring 207, which has an outer surface shaped with an edge on which it can pivot slightly, also sits in a right angled annular groove 209 formed between the spindle 201 and the inner surface of a nut 212 screwed on the end of spindle 201. These perforated rings 207, 208 are mounted in the piston body with seals 211.

The floating assembly of piston 202 and perforated rings 206, 207 is held together, during the assembly operation and when no hydraulic pressure is applied, by centering springs 210. The perforations in rings 208, 209 partially hydraulically balance the system and ensure lubrication of the contacting surfaces of pieces 208, 209 and piston 202 by oil passing through restricted passages 216 with one-way check valves 216. Such lubricating arrangement allows the piston 202 to oscillate radially without causing wear to the contacting surfaces. When the piston is moving forward under pressure, the ring 206 cannot move backwards because of the hydraulic fluid entrapped in the groove 208. When the piston moves backwards, the pressure needed to make it move is equivalent to the sum of the return resistance only and therefore is low enough to permit the resulting force to be taken up by spring 210.

The nut 212 forming the forward end of piston A4 has an inclined surface forming a hydraulic brake which absorbs residual impact at the end of stroke. Final impact is further cushioned by an elastomer ring 213, carried by nut 212, and which at the end of stroke contacts a synthetic ring 214 carried by an end piece 215, allowance being made for any angular displacement of the nut 212. Note also that at the forward end of the piston 202 only its outer shoulder of reduced section is exposed to hydraulic pressure, which means that only a part of the force is transmitted via the floating piston 202, the rest of the force being transmitted via the nut 212 and spindle 201.

FIG. 5 shows another embodiment of floating piston that is free to oscillate angularly in relation to the rod's axis. In this embodiment of the piston A4 or A5, A5 being shown, a ferrule 250 screwed in the end of a tubular piston rod A3 carries a precision-ground steel ball 251 on a threaded shank 252. The outer semi-spherical part of ball 251 is received in a corresponding precision-ground semi-spherical cavity in a piston 253 optionally fitted with a hydraulic brake end 255, though the piston could be made in one piece if desired. The outer cylindrical piston surfaces carry seals 256 and piston guide rings 257 for example made of reinforced polymer, graphite bronze etc. which glide on the inside surface of cylinder A2. The ball 251 is held in the semi-cylindrical housing of piston 253 by a retaining ring 258. This ring 258 may be made of reinforced synthetic material or a lubricating soft metal such as bronze, and is dimensioned in accordance with the pressure requirements in order to resist the maximum stresses at the beginning of a precompression cycle.

In the ferrule 250 is a central bore 259 with a flow restrictor 260, connected to oil at the pressure end of the cylinder by a central tube 261. Bore 259 communicates with a plurality of radial bores 262 in ball 251 extending to its semi-spherical surface in contact with the semi-spherical cavity. This oil permanently lubricates the contacting semi-spherical surfaces. Leakage of oil is prevented by a seal 263 fitted in a groove adjacent to the periphery of the semi-spherical cavity of the piston. The flow restrictor 260 reduces the stress on the retaining ring 258 at the beginning of the pumping stroke.

At the other end of the piston rod A3 a piston A4 of similar ball-and-socket design is provided, but with a narrower piston that is adapted in size and shape to the smaller diameter cylinder A1 and is possibly made in one piece. Also, at this end, the piston body 253 is provided with a central bore communicating the contacting semi-cylindrical surfaces with the pressurized oil in the cylinder A1, enabling pressurized oil to be supplied via tube 261 to the piston A5 at the other end of rod A3, there being no flow restriction 260 at the end of piston A4.

The return speed of the pistons depends, in the first place, on the machine's suction conditions; in other words, the return stroke speed is limited by the characteristics of the material to be pumped and the pressure under which the material is fed to the machine's intake distribution conduit 3. It is an unique feature of this invention that, in any case, when, once the return speed has been determined, if it is desired that the advance speed be higher than the return speed chosen, the relation of the return to the advance speed must be representable by two integers, their sum being equal to the number of modules employed.

Example: in a five-module machine, if the relation return-to-advance speed is 3:2, the sum of 2+3=5, and the rule is met. This means that the product of the number of the pistons in simultaneous advance, at any time, during the machine's combined work cycle, by the advance speed, must be equal to the corresponding product of the returning pistons' speed by their number. The number of simultaneously advancing and simultaneously returning pistons during any portion of the machine's combined work cycle remains constant. The machine's combined cycle is defined as the lapse of time during which all the modules have realized one work cycle. If, on the contrary, the return speed is higher than the advance speed, any relation between them can be adopted. If, in such case, the relation of the advance to the return speed cannot be represented by two integers summing up to the modules' number, the number of the advancing, versus the returning pistons (at any time, during the machine's combined work cycle) varies along this cycle and, consequently, the speed of the advancing pistons varies along the cycle. Obviously, the return speed remains constant in this case also, since it is fully independent of the advance speed.

The return mechanism is completed by a piston position detection system (not shown) and by a hydraulic fluid renewal system. This fluid renewal system is composed of an auxiliary pump 13 fed from conduit 10, a flow restriction valve 14 and a filter 15 (see FIG. 1).

On each module a piston position detector is installed which signals to the PLC or to the microprocessor the instant at which the piston comes close to the end of its forward stroke. This instant is chosen to be in sufficient advance to the piston's end-of-stroke to allow the programmed electronic logic device sufficient time to complete the closure and the immediate, subsequent opening of the hydraulic fluid return and admission valve of that module, which represents the most immediate logic control step (according to the program) before the fluid admission valve of the module causing the signal is closed and, immediately afterwards, its return valve is opened, permitting the signal-causing module to initiate its return stroke.

When the relation of the advance to the return stroke speed cannot be represented by two integers summing up to the number of the modules, that is when the advance speed may vary along the machine's work cycle, a second piston position detector is required on some of the modules, in an intermediate position along the stroke. This position is in each case, determined according to the logic program being used. This detector's position along the stroke of the module can be changed easily and it can be transferred from one module to another, when the program is changed. This detector fulfills an identical mission to the detectors installed near the end of the advance stroke. The detectors used can be of the "Reed magnetic switch", magnetic flux oscillation, ultrasonic type or other types depending, among other factors, on the materials employed for the construction of the cylinders. These detectors are installed on the cylinder's exterior surface, in such a way that they can be easily repositioned along the cylinder's length. As a rule, in all cases, whenever any one of the pistons has arrived at the end of its return stroke or is about to reach it, either there is another piston at the end of its advance stroke or about to reach it or, otherwise, another piston is in a determined, intermediate position along the advance stroke length. Such end and intermediate positions are detected by the corresponding piston detector that sends a signal to the electronic logic control of the machine, which, in turn, will order the return valve of the cylinder that has arrived at (or is close to) the end of its return stroke, to close, then its fluid admission valve to open and, finally (if the signalling module is close to its advance stroke's end) to close the signalling module's admission valve and subsequently open its return valve.

Figure 2:
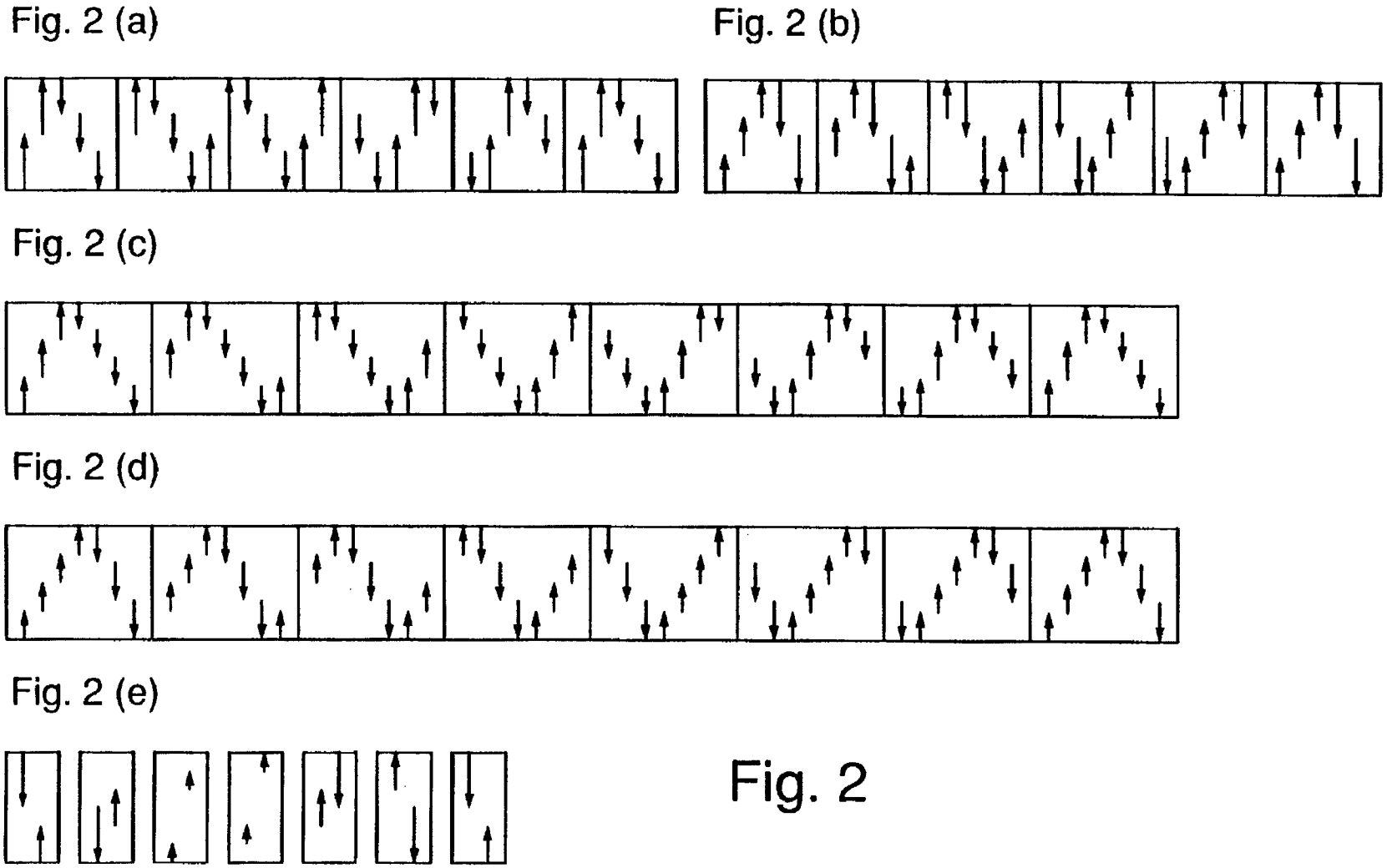
FIGS. 2(*a*)–2(*e*) consist of five simplified vectorial representations of the pistons throughout a complete work cycle in pumps of five, seven and two modules, with forward to return speed relations of 3:2, 2:3, 4:3, 3:4 and 1:1.5.

The vector diagrams shown in FIG. 2 with an indication of the detectors' position, illustrate the above explained text. In these diagrams, each arrow represents a piston e.g. A4, B4, . . . E4 and the displacement it has just undergone. Each diagram block represents the successive positions of the pistons for one complete cycle, plus the first position of the next cycle.

The upper two diagrams (a) and (b) represent five-module units. In diagram (a) the ratio of the forward speed F to the return speed R is 3:2. In the starting position, piston B4 is at the end of the advance stroke while piston E4 is at the end of the return stroke. In the second position, piston A4 is at the end of the advance stroke while piston D4 is at the end of the return stroke. In the third position, piston E4 is at the end of the advance stroke while piston C4 is at the end of the return stroke. In the fourth position, piston D4 is at the end of the advance stroke while piston B4 is at the end of the return stroke. In the fifth and last position of the cycle, piston C4 is at the end of the advance stroke while piston A4 is at the end of the return stroke. The sixth position is the same as the first, i.e. the start of a new cycle.

In diagram (b) for a five-module unit, the ratio F:R is 2:3.

The middle diagrams (c) and (d) represent seven-module units, the first having a ratio F:R of 4:3, and the second a ratio F:R of 3:4.

The lower diagram (e) represents a two-module unit where the ratio F:R is 2:3 in the first, second, fifth and sixth positions, whereas in the intermediate third and fourth positions both pistons are advancing at half the advance speed of the other positions. The seventh position is the same as the first, i.e. the start of a new cycle.

A more detailed description of the valves' operation is as follows:

The initial position of the pistons of the machine is established according to the number of modules, the return stroke speed that has been selected and the forward speed. The forward speed depends on the total available flow of hydraulic fluid supplied by the hydraulic pumps 1, 2, especially if these pumps are of the fixed delivery type and not the variable delivery type. The corresponding valve positions, opened or closed, are established accordingly, either electrically through the machine's electronic logic control or manually, if need be, by means of the pilot valves' manual controls. The use of several hydraulic pumps, instead of one, especially if one of them is of the variable delivery type, allows variation of the flow to adjust it to different operating conditions. The machine is started once the pistons and their corresponding valves have been positioned according to the precalculated programmed electronic logic control. The positions of all the pistons of the machine initially and also at any moment during the machine's combined work cycle are distributed along the stroke's length and no two of the pistons ever coincide in their position ("position", in this context is considered to be the piston's position along its stroke, accompanied by its respective valve positions).

The cartridge valves 300 are equipped with position detectors (closed, opened). These position detectors signal their situation to the electronic logic control. In this way no admission valve is opened if the corresponding return valve has not signalled before that it has closed. It should be apparent now that the flow delivered by the machine remains constant since, at any time during the machine's combined work cycle, the hydraulic fluid supplied by the pump(s) is admitted to the pistons in its entirety, none of it being deviated at any time. It has already been mentioned that, in order to precompress the pumped material in the secondary cylinder, additional hydraulic fluid is injected into the hydraulic cylinder by the module's hydropneumatic accumulator A14, B14, . . . E14 when the corresponding valve is opened, at the beginning of the advance stroke. This hydraulic fluid is supplied continuously to these accumulators from the hydraulic pumps 1, 2, via the valves' manifold A11, B11 . . . E11 through an adjustable restricted flow passage. A check valve A13, B13 . . . E13 is fitted in this restricted flow passage. In this way, even though the necessary volume of hydraulic fluid is supplied by the same pump(s) that supplies the main flow for the forward stroke of the pistons, this main flow does not undergo any pressure drop when the admission valve is opened. This will, however, be true only if the pressure drop in each of these accumulators during its discharge is limited to a very low value. This is achieved by connecting all the individual precompression accumulators to the additional gas reservoir 22 of sufficiently large volume, in relation to the individual accumulator's gas volume.

It has been indicated before that the volume of hydraulic fluid contained in the return stroke mechanism portion of the machine, does not always remain constant during the machine's combined work cycle. This volume undergoes changes during the machine's cycle whenever the relation of the return to forward speeds of the pistons cannot be expressed by two integers such that their sum equals the number of modules in use. As explained previously, the or each accumulator 12 mounted on the distributor-collector conduit 11 that collects and distributes the fluid displaced by the back of the pistons on their forward stroke and pushes them back on the return stroke, absorbs such possible total volume changes and, at the same time, pressurizes the return stroke.

The fluid circulating in this system must be regularly replaced by clean and cooled fluid, since the system, as any hydraulic system, generates contamination and heat. Therefore, a permanent, continuous fluid replenishing mechanism is provided. It consists of an auxiliary medium-pressure pump 13, one or two filters 15, 16 and two flow restriction valves 14, 19. The auxiliary pump 13 draws hydraulic fluid from the distributor pipe 10, passes it through a filter 16 and optionally an additional heat exchanger (not shown) and from there the fluid is divided into two streams 17 and 18, illustrated in dashed lines. Stream 17 is directed to the pistons' return mechanism fluid distributor-collector 11 and the remaining fluid stream 18 is directed via flow-restriction valve 19 to conduit 7. The clean fluid continuously displaces the hot and contaminated fluid contained in the piston's return mechanism circuit and leaves the distributor-collector 11 through its opposite end, traversing flow restriction valve 14 and a second filter 15 from where it is directed to the return fluid collector conduit 7 in order to be cooled before reaching the pumps supply conduit 10 again.

Any one of the modules composing the machine can be withdrawn from the machine for routine maintenance or repair or in order to reduce the machine's capacity at any moment, or to be fitted as an additional module to another machine. The withdrawal or the addition of a module requires only a short time if, in the case of addition, the necessary connections have been foreseen in the original machine. The withdrawal of a module does not necessarily mean that the machine's capacity must be reduced. As long as the original hydraulic pump(s) 1,2 delivery can be maintained, the production of the machine can be maintained by raising the forward stroke speed of the remaining modules. The machine then has to operate with a different program.

The valves at A6, B6 . . . E6 and A7, B7 . . . E7 employed in the fluid end (pumping end or material end) of the machine, when the machine is used to pump liquids or liquids with small solids, are advantageously of novel design. They are designed to close at lower speed that conventional disk (poppet) valves and produce much smaller pressure drops. Additionally, these valves have a straight-line flow-through in place of a 90° deviation as in the case of conventional disk valves.

Special valves are also designed for applications where abrasive liquids are pumped including a valve with a completely sealed and internally lubricated travel mechanism. All these new valves adjust the valve body to the valve's seat during closure, automatically.

Figures 7A, 7B:
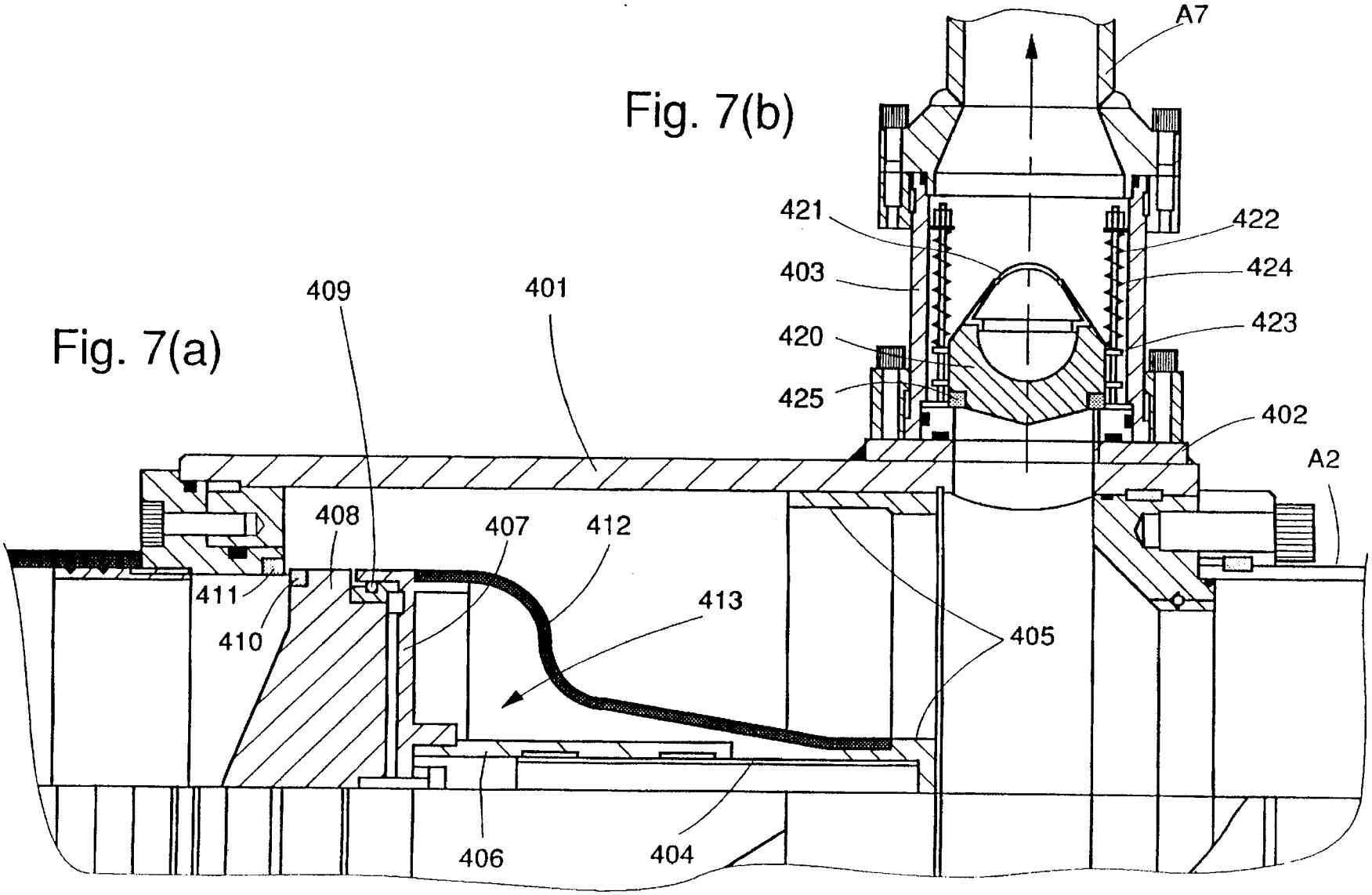
FIG. 7*a* is a partial cross section of one embodiment of a material suction valve.
FIG. 7*b* is a similar view of one embodiment of a material delivery valve.

These valves are a secondary object of the invention and are illustrated in FIGS. 7*a* and 7*b* which show material intake and material outlet valves respectively. The material intake A6 is connected to a generally cylindrical material intake valve body 401 on one side of which a material outlet valve body 403 is connected by a reinforcing saddle 402. The material cylinder A2 is connected in alignment with intake A6 and body 401. Mounted coaxially inside body 401 is an interior tube 404 fitted on a central ferrule of a perforated annular mount 405. On tube 404 is a sliding valve tube 406 carrying a disc 407, together forming a sliding valve body, there being interposed slide rings to assist smooth sliding. Disc 407 carries a valve poppet 408 mounted centrally by means of a bolt 414 mounted with play in a central aperture in disk 407, with a rubber washer 415 which allows the bolt 414 to pivot. At its periphery, the poppet 408 is retained by means of a floating conical ring 409 analogous to ring 207 of FIG. 4, which allows slight angular oscillation of the poppet in respect to the valves axis so that is will at any time automatically adjust to the valve seat. The edge of poppet 408 has an insert 410 able to apply against a seat 411 carried by an end cover of body 401. Between the outer edge of disc 407 and the central ferrule of annular mount 405 is a flexible elastomer cover 412 forming a space enclosing a lubricant 413, such as oil. The inside of tubes 404 communicates with the lubricant-filled space 413 by one or more holes situated adjacent the entry of the tube in the ferrule.

The pressure differential between the intake A6 and material cylinder A2 at the beginning of a suction stroke suffices to displace poppet 408 from its seat, the elastomer 412 bulging out to compensate for the axial displacement, because the quantity of the enclosed lubricant 413 remains constant. When the pressure differential acts the other way at the beginning of the delivery stroke, the valve closes automatically. The maximum displacement of the sliding valve body is defined by the distance between the end of tube 406 and the central ferrule of annular mount 405. The axial alignment of intake A6 with the material cylinder A2 minimizes resistance to the intake of the abrasive liquid during the suction stroke.

The material outlet valve shown in FIG. 7*b* comprises a floating hollow poppet body 420 closed by a cover 421, slidably mounted on several stems 422, usually four stems at 90° to one another, by means of lugs 423 with openings which fit with play over the seems 422. Coil springs 424 around the stems press poppet body 420 to normally keep its insert 425 against a seat 426 formed by a ring mounted with seals. During the delivery stroke, the pressure differential causes the poppet body 420 to lift up, allowing the pumped material to be delivered via the out let A7.

The above-described valves are all especially adapted for pumping liquids or liquids containing small particulate solids. It is also possible to use existing types of valve systems for semi-solid media. When media containing large solids are to be pumped, hydraulically driven sliding valves or other similar valves can be used, the proper control sequence being also controlled by the machine's electronic logic circuit.

We claim:

1. A hydraulic fluid-driven, multicylinder, modular, reciprocating piston pumping machine, of non-pulsating flow, comprising a plurality of like pumping modules (A,B . . . E) each having one primary cylinder (A1,B1 . . . E1) and one secondary cylinder (A2,B2, . . . E2) coaxially joined to each other by interposition of a bushing (100) through which slides a piston rod (A3,B3 . . . E3) with a piston (A4,B4 . . . E4; A5,B5 . . . E5) attached to each of its ends, wherein:

each secondary cylinder (A2,B2 . . . E2) is provided, at the end opposed to the bushing (100) with suction and delivery valves that connect the individual modules to a suction distributor conduit (3) and to a delivery collector conduit (4) respectively, both of these latter conduits being connected to their respective individual modules via shut-off valves (A17,B17 . . . E17; A16, B16 . . . E16);

each primary cylinder (A1,B1 . . . E1) has the end opposed to the bushing closed by a valve manifold (A11, B11 . . . E11), all of the individual module's valve manifolds being interconnected through a pressurized hydraulic fluid distributor conduit (5) through which pressurized hydraulic fluid is supplied by at least one hydraulic pump (1,2), the pressurized hydraulic fluid being supplied to the primary cylinder of each module for advancing the pistons through a forward stroke; and a hydraulic fluid chamber (A18,B18 . . . E18) formed in each primary cylinder by a back side of the piston, said bushing (100), the rod's surface and the cylinder's interior wall, communicates by means of a distributor-collector conduit (11) with all such chambers (A18,R18 . . . E18) of the rest of the modules for returning the pistons through a return stroke, said distributor collector conduit (11) being provided with at least one hydro-pneumatic accumulator (12), characterized in that said hydro-pneumatic accumulator (12) is connected via the distributor-collector conduit (11) to a relatively large, supplementary gas reservoir (23) constituting a volumetric compensator for all the hydraulic fluid contained in all said chambers (A18, B18 . . . E18), and at the same time providing pressure for the return stroke of the pistons (A4,B4 . . . E4) at a return stroke speed which is variable independently of the forward stroke speed.

2. The pumping machine according to claim 1, wherein:

the valve manifold (A11,B11 . . . E11) of each module is connected to the pressurized hydraulic fluid distributor conduit (5) via a shut-off valve (A15,B15 . . . E15), all said manifolds (A11,B11 . . . E11) also being connected in parallel to a return hydraulic fluid collector conduit (7); and said return fluid collector conduit (7) is connected via shut-off valves (A19,B19 . . . E19) to the respective manifolds (A11,B11 . . . E11) and is also connected to at least one second hydro-pneumatic accumulator (8), said second accumulator (8) being connected to a relatively large, second supplementary gas reservoir (22).

3. The pumping machine according to claim 2, wherein each modular valve manifold (A11,B11 . . . E11) has an individual third hydro-pneumatic accumulator (A14, B14 . . . E14) supplied with pressurized hydraulic fluid from the manifold (A11,B11 . . . E11), each of these third accumulators (A14,B14 . . . E14) being connected to a large pressurized third supplementary gas reservoir (20) providing all these third accumulators with additional pressurized gas volume, the volume of this third reservoir being many times larger that the individual gas volume of each third accumulator.

4. The pumping machine according to claim 3, wherein each modular valve manifold (A11,B11 . . . E11) has three valves: a hydraulic fluid admission valve ((A8,B8 . . . E8) a hydraulic fluid return valve (A9,B9 . . . E9) and a third valve (A10,B10 . . . E10) that communicates with the individual third hydro-pneumatic accumulator (A14,B14 . . . E14) provided on each modular valve manifold, each individual third hydro-pneumatic accumulator (A14,B14 . . . E14) being supplied with pressurized hydraulic fluid from the manifold (A11,B11 . . . E11) through a variable flow restriction passage and a check valve.

5. The pumping machine according to claim 1, wherein said bushing (100) of each module constitutes, with respect to the corresponding piston rod, a sealing guide, free to oscillate both angularly and radially in relation to the axis of the cylinders, and the pistons (A4,B4 . . . E4;A5,B5 . . . E5) are free to oscillate angularly with respect to the piston rod's axis.

6. The pumping machine according to claim 1, wherein the distributor-collector conduit (11) is connected at one of its ends to a filtered and cooled hydraulic fluid supply from an auxiliary pump (13) equipped with a filter (16), its opposite end being connected to a flow restriction valve (14) and a filter (15) from which the fluid goes to the return hydraulic fluid collector conduit (7).

7. The pumping machine according to claim 1, wherein the initial position of the pistons, before the pumping machine is started, is a function of (i) the number of modules making up the pumping machine and (ii) the relation between the forward and return speeds of the pistons at any moment during the pump's work cycle, and wherein as long as the hydraulic fluid flow from the hydraulic pump is kept constant, the sum of the individual speeds of the advancing pistons is equal to the sum of the individual speeds of the returning pistons.

8. The pumping machine according to claim 1, wherein opening and closing of the valves is controlled based on the stroke timing as a function of the hydraulic pump(s) flow.

9. The pumping machine according to claim 1, wherein the return hydraulic fluid collector conduit (7) discharges into at least one hydraulic fluid heat exchanger (9) delivering the hydraulic fluid back to the hydraulic pump (1,2).

10. The pumping machine according to claim 1, wherein the distributor-collector conduit (11) is connected at one of its ends to a filtered and cooled hydraulic fluid supply coming from an auxiliary pump (13) equipped with a filter (16), its opposite end being connected via a flow restriction valve (14) and via a filter (15) to the return hydraulic fluid collector conduit (7).

11. The pumping machine according to claim 1, wherein fluid communication between components of said pumping machine is hermetically sealed.

* * * * *